US009835370B2

(12) United States Patent
Jung et al.

(10) Patent No.: US 9,835,370 B2
(45) Date of Patent: Dec. 5, 2017

(54) FREEZER, IN PARTICULAR ULTRA-LOW TEMPERATURE FREEZER

(71) Applicant: Eppendorf AG, Hamburg (DE)

(72) Inventors: Sung-Han Jung, Enfield, CT (US); Erik Zamirowski, Longmeadow, MA (US)

(73) Assignee: EPPENDORF AG, Hamburg (DE)

( * ) Notice: Subject to any disclaimer, the term of this patent is extended or adjusted under 35 U.S.C. 154(b) by 210 days.

(21) Appl. No.: 14/487,855

(22) Filed: Sep. 16, 2014

(65) Prior Publication Data

US 2016/0076802 A1 Mar. 17, 2016

(51) Int. Cl.

| | |
|---|---|
| ***F25C 1/22*** | (2006.01) |
| ***F25D 23/08*** | (2006.01) |
| ***F25D 23/02*** | (2006.01) |

(52) U.S. Cl.

CPC ..... *F25D 23/087* (2013.01); *F25D 23/025* (2013.01)

(58) Field of Classification Search

CPC ..... F25D 23/00; F25D 23/087; F25D 23/025; F25D 21/00

See application file for complete search history.

(56) References Cited

U.S. PATENT DOCUMENTS

| | | | | |
|---|---|---|---|---|
| 2,327,672 | A * | 8/1943 | Schweller | F25D 11/02 312/315 |
| 2,745,259 | A * | 5/1956 | Saunders | F25D 11/022 312/296 |
| 4,424,559 | A | 1/1984 | Lorinez et al. | |
| 4,634,675 | A | 1/1987 | Freedman et al. | |
| 4,680,267 | A | 7/1987 | Eppstein et al. | |
| 4,727,040 | A | 2/1988 | Freedman et al. | |
| 4,971,276 | A | 11/1990 | Tannenbaum | |
| 5,052,812 | A | 10/1991 | Tannenbaum et al. | |
| 5,058,619 | A | 10/1991 | Zheng | |
| 5,339,643 | A * | 8/1994 | Pikaart | F25D 23/025 62/272 |
| 5,372,425 | A | 12/1994 | Tannenbaum et al. | |
| 5,443,802 | A | 8/1995 | Freedman et al. | |
| 5,501,971 | A | 3/1996 | Freedman et al. | |
| 5,593,228 | A | 1/1997 | Tannenbaum | |
| 5,600,966 | A * | 2/1997 | Valence | F25D 11/04 312/401 |
| 5,762,228 | A * | 6/1998 | Morgan | B65D 47/0895 16/257 |
| 6,299,344 | B1 | 10/2001 | Tannenbaum | |
| 8,522,996 | B2 | 9/2013 | Beese et al. | |
| 2005/0138955 | A1 * | 6/2005 | Okuda | F25D 23/025 62/441 |
| 2010/0019907 | A1 | 1/2010 | Shanks | |

(Continued)

FOREIGN PATENT DOCUMENTS

| | | | | |
|---|---|---|---|---|
| CN | 102645066 | A * | 8/2012 | F25D 11/00 |
| GB | 720692 | A * | 12/1954 | F25D 23/025 |
| WO | WO 2009/065110 | A1 | 5/2009 | |

*Primary Examiner* — Elizabeth Martin

(74) *Attorney, Agent, or Firm* — Merchant & Gould P.C.

(57) ABSTRACT

An ultra-low temperature freezer comprising an interior and a housing surrounding the interior and having an outer door. The interior comprises several cooling compartments in a stacked arrangement, each cooling compartment having an inner door. At least one upper cooling compartment has a supplementary seal for sealing its inner door compared to at least one lower cooling compartment.

10 Claims, 4 Drawing Sheets

(56) References Cited

U.S. PATENT DOCUMENTS

| | | | | |
|---|---|---|---|---|
| 2010/0156090 | A1 | 6/2010 | O'Connor | |
| 2010/0178170 | A1 | 7/2010 | Leso et al. | |
| 2011/0220663 | A1* | 9/2011 | Guba | F25D 17/047 220/592.02 |
| 2011/0286298 | A1 | 11/2011 | Zamirowski et al. | |
| 2012/0294107 | A1 | 11/2012 | Zamirowski et al. | |

* cited by examiner

FREEZER, IN PARTICULAR ULTRA-LOW TEMPERATURE FREEZER

BACKGROUND

This patent document is directed to a freezer, in particular ultra-low temperature freezer, comprising an interior and a housing surrounding the interior and having an outer door, wherein the interior comprises several cooling compartments in a stacked arrangement and wherein each cooling compartment has an inner door.

Freezers and ultra-low temperature freezers are known in the prior art and are used, for example, in chemical, biological, biochemical, medical or forensic laboratories for storing laboratory samples, in particular solid, gel-like or liquid samples, at low temperatures, in particular ultra-low temperatures. Low temperatures are considered to range between 0° C. and −50° C., while ultra-low temperatures are considered to range between −50° C. and −90° C. Under such conditions, laboratory samples based on an aqueous solution and many other liquid, gel-like or solid samples will freeze.

Freezers are typically upright freezers, which are placed on the floor or under bench. The freezers have an interior or inner volume for storing the samples, and a housing is provided surrounding or encasing the interior or inner volume. The housing includes an outer door or access door, which is often a front door hinged to a side edge of the housing. The housing of the freezer is typically configured to thermally insulate or isolate the interior of the freezer from the surrounding atmosphere, in particular to provide a thermal isolation for providing (ultra-) low temperatures within the interior. Typically, a freezer is substantially in the form of a cuboid and also has a substantially cuboid-shaped interior, which is limited by the housing of the freezer.

The cooling of the interior of the freezer usually is achieved by the provision of an (ultra-) low temperature refrigeration unit. The cooling of a freezer, for example, can be achieved by cooled inner walls, which contact the interior. The cooling may be achieved by conduction of heat from the air inside the inner volume to the cooled inner walls, which is supported by the convection of the air. Evaporation or cooling tubes of a refrigeration system can be provided to cool the walls, which can be connected to an (ultra-) low temperature refrigeration unit, which may be arranged, for example, below the interior of the freezer.

To provide for optimized storing conditions, a substantially uniform temperature distribution within the freezer is preferred. For example, large temperature differences between different cooling compartments may lead to differences in the storing conditions in these compartments and may have a negative influence on the samples stored therein.

It is therefore an object to provide a freezer, in particular an ultra-low temperature freezer, with an improved temperature distribution, in particular an improved temperature uniformity within the freezer interior.

SUMMARY

This object is solved by a freezer, in particular ultra-low temperature freezer, comprising an interior and a housing surrounding the interior and having an outer door, wherein the interior comprises several cooling compartments in a stacked arrangement and wherein each cooling compartment has an inner door, and wherein at least one upper cooling compartment has a supplementary seal for sealing its inner door compared to at least one lower cooling compartment.

This patent document is based, inter alia, on the surprising finding that the provision of a complementary seal on at least one upper cooling compartment compared to at least one lower cooling compartment significantly increases temperature uniformity within a freezer and significantly reduces temperature differences within the freezer interior and between different cooling compartments.

Within the interior of the freezer, several cooling or inner compartments are provided to divide the interior. The cooling compartments are arranged in a stacked manner, which means that the cooling compartments are arranged on top of each other or one upon the other. Each cooling compartment has an inner volume, which is encased by a casing and can be accessed through the inner door or cooling compartment door of the cooling compartment. Such cooling compartments allow separating samples from each other, which can be desirable, for example, in a laboratory, where a variety of different samples has to be cooled. The cooling compartments each have a cooling compartment door, which can also be referred to as inner door. In this way, the cooling compartments can be accessed individually, i.e., if one cooling compartment is to be opened, the other cooling compartments may remain closed. Each compartment may have the shape of a cuboid and have a substantially cuboid-shaped inner volume. The inner doors preferably are hinged on the cooling compartments and can be swung open about a vertical axis. Further, the inner doors preferably have a handle for opening and/or closing the inner doors.

Herein, if not stated otherwise, the inner doors of the cooling compartments and the outer door of the housing are referred to in their closed position.

At least one upper cooling compartment has a supplementary seal, which is not present in at least one lower cooling compartment. The at least one upper cooling compartment may be stacked directly on top of the at least one lower cooling compartment or one or more cooling compartments may be arranged between the at least one upper and the at least one lower cooling compartment. Further, the at least one upper cooling compartment may be the topmost cooling compartment or one or more further upper cooling compartments may be arranged on top of the at least one upper cooling compartment. The at least one lower cooling compartment may be the lowermost cooling compartment or one or more further cooling compartments may be arranged below the at least one lower cooling compartment. Compared to the at least one upper cooling compartment, which has a supplementary seal for sealing its inner door against its casing, the at least one lower cooling compartment does not have such a supplementary seal. In other words, while all cooling compartments usually have some basic sealing arrangement for sealing the inner door against the casing of the cooling compartment in the closed position of the inner door, the at least one upper cooling compartment has a supplementary seal for sealing its inner door, which is not present at the at least one lower cooling cornpartment.

For example, in a freezer having a total of five cooling compartments in a stacked arrangement, it is preferred that at least the topmost cooling compartment, preferably the two topmost cooling compartments, have a supplementary seal for sealing the inner doors of the one or two topmost cooling compartments, and the lowermost four or three cooling compartments do not have such a supplementary seal.

The supplementary seal of the at least one upper cooling compartment for sealing its inner door is preferably arranged and constructed to seal an inner volume of the cooling compartment against the surroundings, i.e. prevent or at least reduce fluid flow into or out of the inner volume of the cooling compartment.

This patent document is further based on the finding that the non-uniforme temperature distribution within existing freezers, in particular ultra-low temperature freezers, is caused by a variety of factors, including the temperature distribution of the refrigerant in a lowstage evaporator; the buoyancy of air; thermal conduction paths among the various assembled components of a freezer; and the partitioning of the inner freezer chamber or interior by shelves or compartments and inner doors. This partitioning may create multiple convective zones, including, for example, an interspace between the inner side of the outer door and the inner doors of the cooling compartments. The multiple convective zones interact with each other and may result in, for example, thermal leak paths, convection and air circulation due to gaps and inadequate sealing. However, a non-uniform temperature distribution means that samples within the freezer will be exposed to different temperatures depending on their location. By improving the sealing of at least one upper cooling compartment through the supplementary seal, the uniformity of the temperature distribution within the freezer can be significantly improved. Surprisingly, such an effect occurs if the supplementary seal is provided on the at least one upper cooling compartment and not on at least one lower cooling compartment.

A preferred embodiment of the freezer is characterized in that the supplementary seal is an integral sealing arrangement with improved sealing characteristics. In this embodiment, the supplementary seal may be, for example, integral with a basic sealing arrangement present at all of the cooling compartments, and provide this basic sealing arrangement with sealing characteristics, for example through an improved material, an improved shape or a combination thereof.

In another preferred embodiment, the supplementary seal is a separate, additional sealing arrangement. In this embodiment, the supplementary seal may be provided as an individual supplementary sealing arrangement in addition to a basic sealing arrangement, which preferably is present in all cooling compartments. The supplementary seal in this embodiment is preferably provided as a further sealing arrangement, which is separate from a basic sealing arrangement.

In a further preferred embodiment the supplementary seal is arranged at the at least one upper cooling compartment. In particular, in this embodiment the supplementary seal may be arranged at the face of a casing of the upper cooling compartment facing the inner door or cooling compartment door.

Further, it may be preferred that the supplementary seal is arranged at the inner door of the at least one upper cooling compartment. In this embodiment, the supplementary seal is provided at the inner door, preferably at an inner side of this inner door facing the inner volume of the at least one upper cooling compartment. The supplementary seal preferably is arranged and constructed such that it contacts the face of the casing of the at least one upper cooling compartment facing the inner side of the inner door when the inner door is closed.

In a further preferred embodiment, the supplementary seal is arranged on an inner side of the outer door facing the interior. The supplementary seal preferably is arranged and constructed such that it contacts the inner door of the at least one upper cooling compartment, in particular when the outer door is in its closed position.

In a further preferred embodiment the supplementary seal has an extension in a horizontal direction which corresponds to a horizontal distance between the at least one upper cooling compartment, in particular its inner door, and an inner side of the outer door facing the interior or is larger than this horizontal distance. The horizontal distance between the at least one upper cooling compartment, in particular its inner door, and the inner side of the outer door facing the interior is meant to be the horizontal distance when the outer door is closed. The horizontal distance between the at least one upper cooling compartment and the inner side of the outer door in the closed position of the outer door corresponds to or results from an interspace between the inner doors of the cooling compartments and the inner side of the outer door. Typically, this interspace is filled with air.

Preferably, the supplementary seal may have a compressed state and a non-compressed state. The supplementary seal preferably is in a non-compressed state when the outer door is opened and is in a compressed state when the outer door is closed.

In this embodiment, the supplementary seal preferably has an extension in a horizontal direction which is larger than the horizontal distance between the at least one upper cooling compartment and the inner side of the outer door in a non-compressed state, i.e., when the outer door is open. This means that the supplementary seal is compressed when the outer door is closed. The more the horizontal extension of the supplementary seal in its non-compressed state exceeds the horizontal distance between the at least one upper cooling compartment and the inner side of the outer door, the larger the compression of the seal becomes. In this embodiment, in particular with a compressed supplementary seal in the closed position of the outer door, pressure is exerted via the supplementary seal on the inner door of the at least one upper cooling compartment, therefore increasing a sealing force on the inner door of the at least one upper cooling compartment and thus improving its sealing.

In a further preferred embodiment the supplementary seal covers a circumferential edge of the inner door of the at least one upper cooling compartment at least partly. The supplementary seal preferably is arranged to cover the circumferential edge of the inner door of the at least one upper cooling compartment at least partly, to seal the connection between the inner door and the casing of the at least one upper cooling compartment in the closed position of the inner door. The supplementary seal may have a substantially rectangular shape corresponding to the circumferential edge of the inner door of the at least one upper cooling compartment.

In a further preferred embodiment, the supplementary seal has at least one recess or gap. Such a recess or gap can be in the form of an opening or discontinuity of the supplementary seal along the circumferential edge of the inner door of the at least one upper cooling compartment. It is further preferred, that the at least one recess or gap is arranged and constructed to receive a handle and/or a hinge of the inner door of the at least one upper cooling compartment. This embodiment, for example, allows for the provision of the supplementary seal on the outer side of the inner door and for a compression of the supplementary seal in the closed position of the outer door, while at the same time an interference between the supplementary seal and a handle and/or a hinge of the inner door is prevented or at least reduced.

It is particularly preferred that the supplementary seal is arranged and constructed such that development of a vertical natural convection boundary layer between an upper and a lower part of the interspace in the interior between the cooling compartments and the inner side of the outer door is prevented or substantially interrupted. In this embodiment, the convection zone formed in the interspace between the inner doors of the cooling compartments and the inner side of the outer door is substantially horizontally divided. Even if this partition of the interspace in the interior between the cooling compartments and the inner side of the outer door is not fully fluid tight or does not provide a perfect natural convection boundary layer interruption, the supplementary seal in this embodiment preferably provides at least some inhibition to a vertical boundary layer development between an upper and a lower part of the interspace, which can further improve temperature uniformity within the freezer.

In a further preferred embodiment, the supplementary seal comprises or consists of a silicon sponge gasket as a sealing material and a uPVC (unplasticized polyvinyl chloride) channel as an insulation material and as a means to mount the silicon sponge on the inner surface of the outer door. The uPVC channel could be secured to the inner surface of the outer door using hot melt glue or fasteners.

DESCRIPTION OF THE DRAWINGS

Preferred embodiments shall now be described with reference to the attached drawings, in which.

In the figures, different embodiments of supplementary seals for ultra-low temperature freezers are shown. Identical elements or elements with substantially identical functions are indicated with the same reference signs in the drawings.

DETAILED DESCRIPTION

Figure 1:
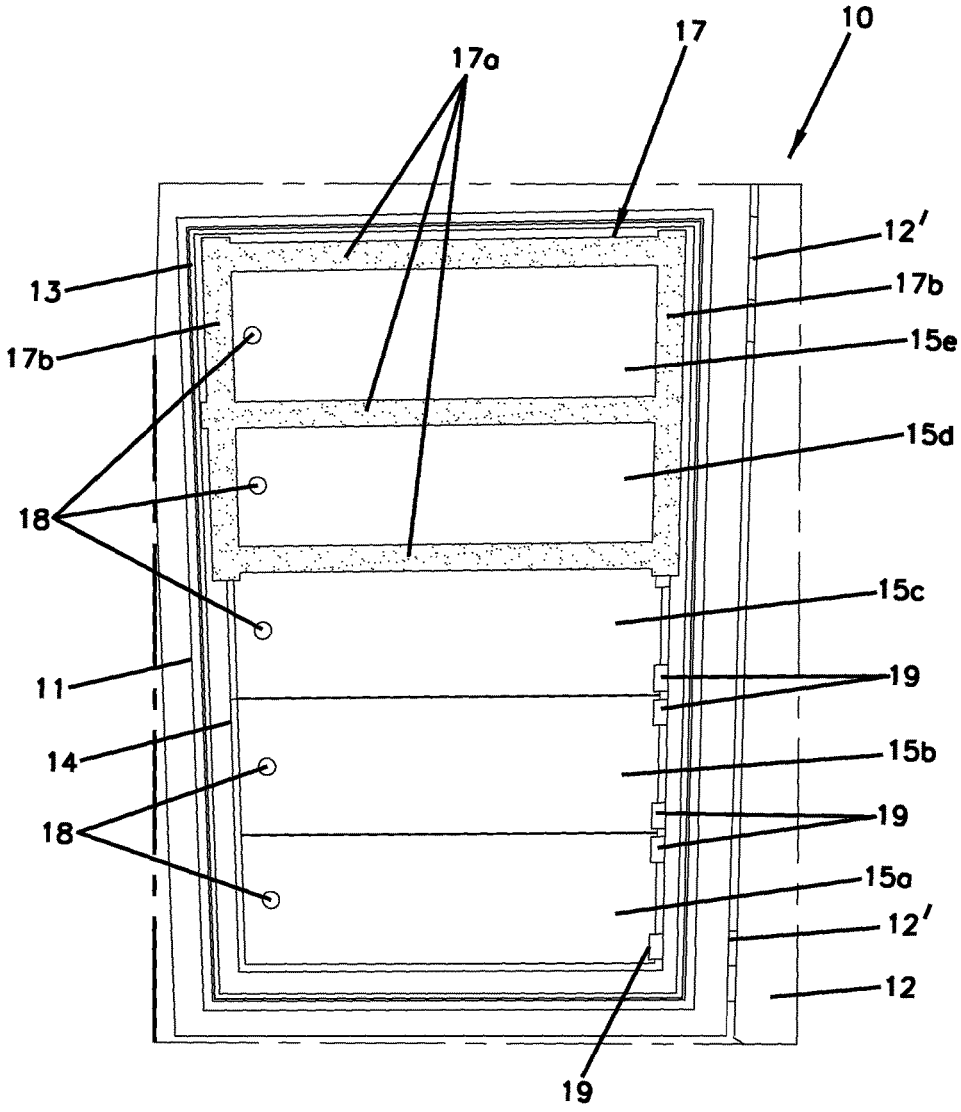
FIG. 1: shows a front view of a freezer (with the outer door in its open position) with a supplementary seal on the two topmost cooling compartments.

FIG. 1 shows an ultra-low temperature freezer 10 with an interior or inner volume 14, which is encompassed by a housing, and which has an outer door 12 (shown only partly). The housing door 12 is hinged about hinges 12' on the housing 11 and can be swung open about a vertical axis through the hinges 12'. FIG. 1 shows the freezer 10 with the outer door 12 in the open position. An outer door sealing arrangement 13 can be seen at the inner edge of the housing 11. Within the interior 14, five cooling compartments 15*a,b,c,d,e* are arranged in a stacked manner, i.e., the five cooling compartments 15*a,b,c,d,e* are arranged on top of each other. Each cooling compartment 15*a,b,c,d,e* is provided with an inner door which is hinged about hinges 19 and which is provided with a handle in the form of a hole or knob 18. The inner doors of the cooling compartments 15*a,b,c,d,e* are shown in FIG. 1 in the closed position and can be swung open about a vertical axis through hinges 19.

In FIG. 1, a supplementary seal 17 is provided on the two topmost cooling compartments 15*d,e*. The supplementary seal 17 is provided as a separate, additional sealing arrangement, which is arranged at the inner doors of the two topmost cooling compartments. In the embodiment in FIG. 1, the supplementary seal 17 is arranged on the outer side of the inner doors of the two topmost cooling compartments 15*d,e* in the form of two vertical sealing strips 17*b* and three horizontal sealing strips 17*a*, covering the circumferential edges of the inner doors of the two topmost cooling compartment 15*d,e*. The supplementary seal 17 shown in FIG. 1, for example, may be an insulation tape approximately 2 inches wide and 3.2 mm thick.

Figure 2:
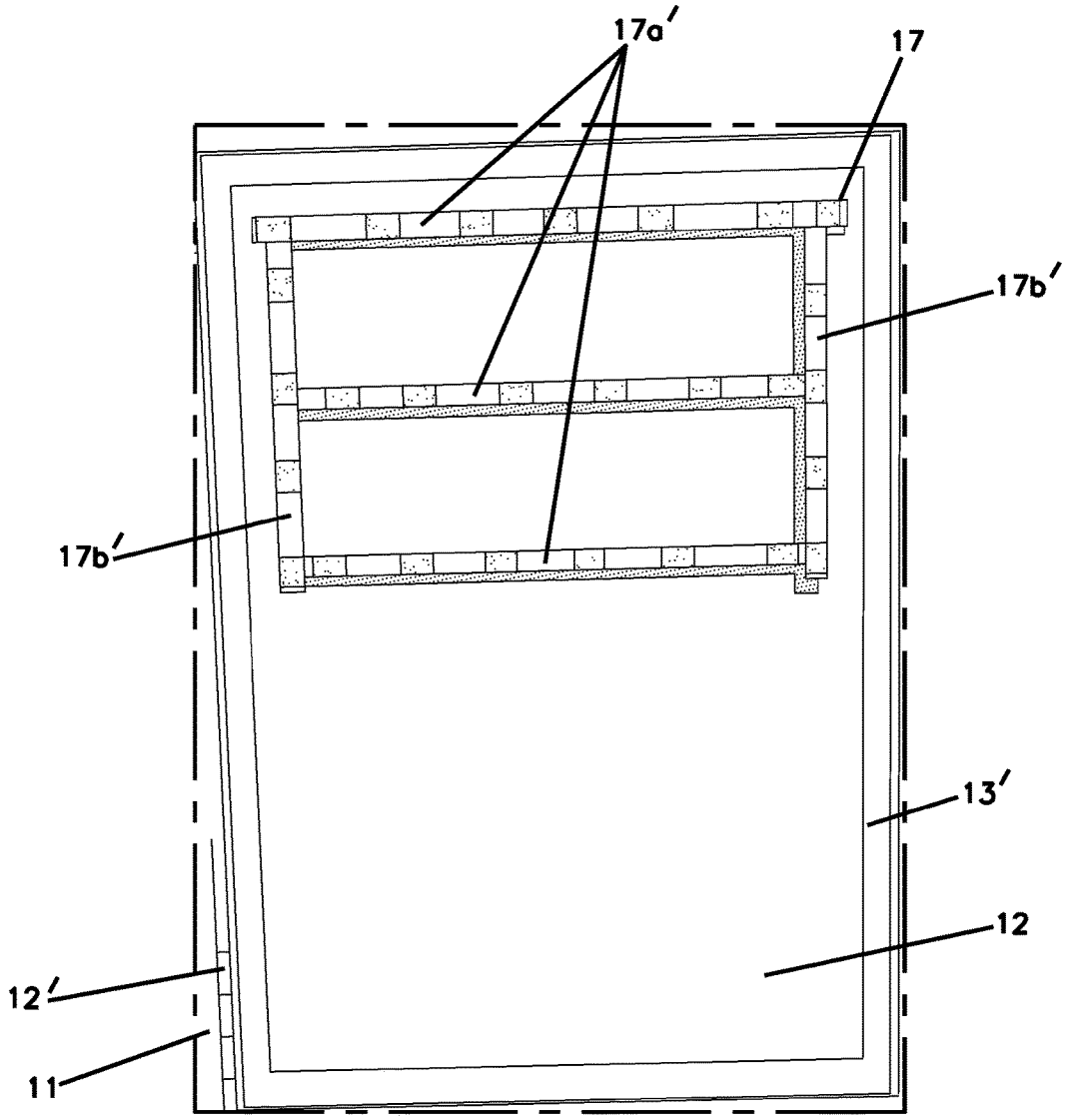
FIG. 2: shows the inner side of an outer door of a freezer with a supplementary seal for two topmost cooling compartments.
Figure 3:
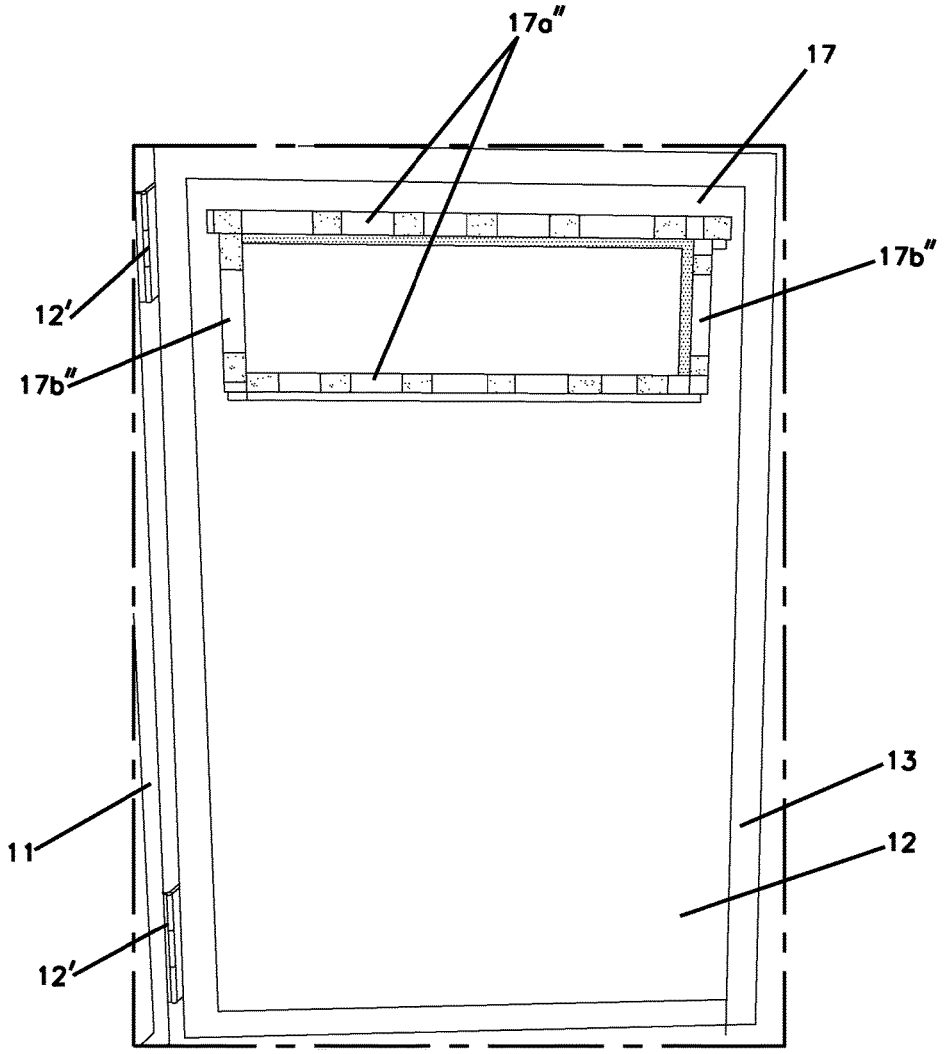
FIG. 3: shows the inner side of an outer door of a freezer with a supplementary seal for the topmost cooling compartment.

In FIG. 2 and FIG. 3, the inner side of an outer door 12 can be seen. On the outer periphery of the inner side of the outer door 12 the counterpart 13' of the outer door sealing arrangement 13 can bee seen. In the upper part of the inner side of the outer door 12, supplementary seals 17', 17" are depicted.

In FIG. 2, the supplementary seal 17' is provided for the two topmost cooling compartments of an associated freezer interior (not shown in FIG. 2). The supplementary seal 17' comprises two substantial vertical bars 17*b'* and three substantially horizontal bars 17*a'* arranged and positioned to cover the circumferential edges of the inner doors of the two topmost cooling compartments. The supplementary seal 17' is substantially in the form of two rectangles.

In FIG. 3, the supplementary seal 17" is provided for the topmost cooling compartment of an associated freezer interior (not shown in FIG. 3) only. The supplementary seal 17" shown in FIG. 3 comprises two substantially vertical bars 17*b"* and two substantially horizontal bars 17*a"* to cover the circumferential edge of the inner door of the topmost cooling compartment. The supplementary seal 17" has a substantially rectangular shape.

Both supplementary seals of FIG. 2 and FIG. 3 are provided at the inner side of the outer door 12, which, in its closed position, faces the associated interior of the freezer. Both supplementary seals 17' and 17" of the embodiments shown in FIG. 2 and FIG. 3 have an extension in a horizontal direction perpendicular to the inner surface of the outer door which, in its non-compressed state with the outer door 12 in the open position as shown in FIG. 2 and FIG. 3, is larger than a horizontal distance between the topmost or the two topmost cooling compartments, in particular their inner doors, and the inner side of the outer door 12 in its closed position. Due to this large horizontal extension, the supplementary seals 17', 17" will contact the inner doors of the one or two topmost cooling compartments when the outer door 12 is in its closed position. Thereby, the supplementary seals 17', 17" cover the circumferential edges of the inner doors of the one or two topmost cooling compartments and thus improve the sealing of these doors. Additionally, the supplementary seals 17', 17" substantially interrupt development of a vertical natural convection boundary layer between an upper and a lower part of an interspace in the interior between the cooling compartments and the inner side of the outer door in the closed position of the door.

Figure 4A:
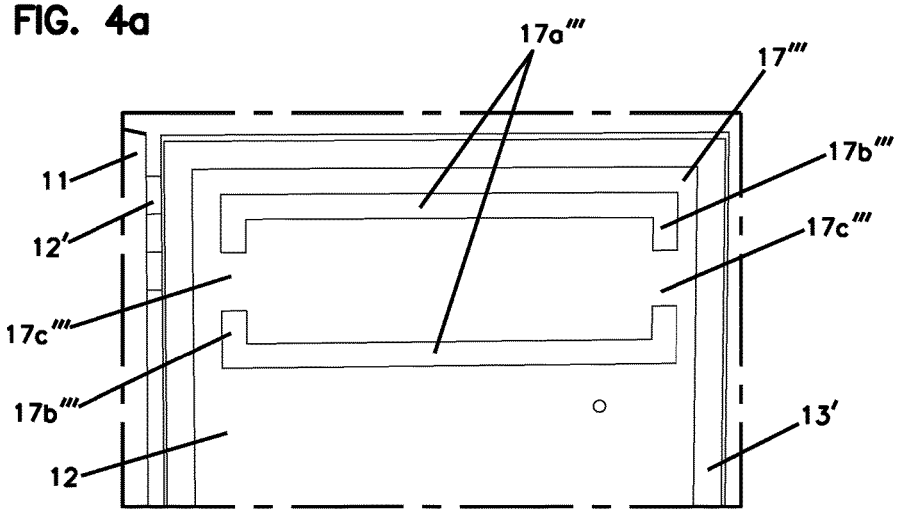
FIG. 4*a*: shows the upper section of the inner side of an outer door of a freezer with another embodiment of a supplementary seal for the topmost cooling compartment.
Figure 4B:
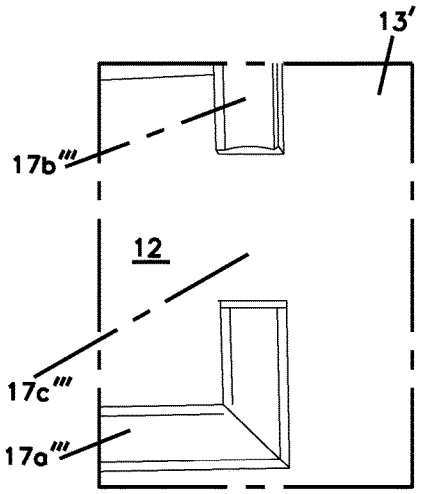
FIG. 4*b*: shows an enlarged view of a part of FIG. 4*a*.
Figure 4C:
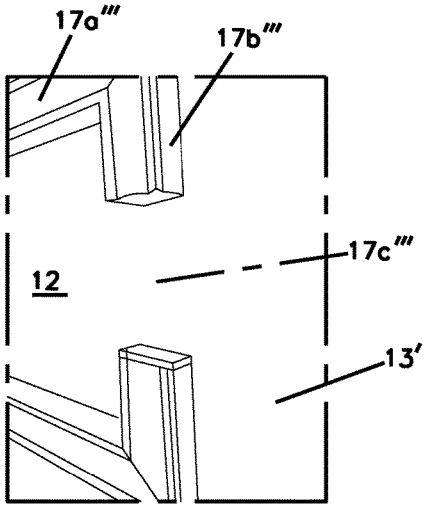
FIG. 4*c*: shows the enlarged view of 4*b* from a different angle.

As can be seen in FIGS. 4*a,b,c*, a supplementary seal 17''' is provided which is similar to the supplementary seal 17" shown in FIG. 3. Also the supplementary seal 17''' in FIG. 4*a,b,c* is arranged for sealing the inner door against the cooling compartment of the topmost cooling compartment of an associated freezer interior (not shown in FIGS. 4*a,b,c*). The supplementary seal 17''' comprises two substantially horizontal bars 17*a'''* and two substantially vertical bars 17*b"*. The supplementary seal 17''' has two recesses or gaps 17*c'''* located in the two horizontal bars 17*b'''*. The recesses or gaps 17*c'''* are arranged and constructed to receive a handle and/or a hinge of the inner door of the topmost cooling compartment. Although the supplementary seal 17''' shown in FIGS. 4*a,b,c* does not fully cover the circumferential edge of the inner door of the topmost cooling compartment when the outer door 12 is closed, the coverage is sufficient to increase the sealing of the inner door of the topmost cooling compartment to enhance temperature uniformity within the freezer.

For example, the supplementary seals 17', 17'', 17''' may comprise a coated silicon sponge as a sealing material and a uPVC (unplasticized polyvinyl chloride) channel as an insulation material and as a means to mount the silicon sponge on the inner surface of the outer door. The uPVC channel could be secured to the inner surface of the outer door using hot melt glue or fasteners.

As can be seen from the embodiments, a variety of cost-effective and practical embodiments to provide an ultra-low temperature freezer with a supplementary seal on at least one upper cooling compartment can be provided to improve the sealing of the at least one upper cooling compartment and thereby improving temperature uniformity within the freezer and in particular across the different cooling compartments.

The invention claimed is:

1. An ultra-low temperature freezer, comprising:

an interior and a housing surrounding the interior and having an outer door;

wherein the interior comprises several cooling compartments with each configured to cool at ultra-low temperatures, wherein the several cooling compartments are in a stacked arrangement and wherein each cooling compartment has an inner door; and wherein at least one upper cooling compartment has a supplementary seal for sealing its inner door compared to at least one lower cooling compartment, and the supplementary seal covers a circumferential edge of the inner door of the at least one upper cooling compartment.

2. The ultra-low temperature freezer according to claim 1, wherein the supplementary seal is an integral sealing arrangement with a basic seal.

3. The ultra-low temperature freezer according to claim 1, wherein the supplementary seal is a separate, additional sealing arrangement.

4. The ultra-low temperature freezer according to claim 1, wherein the supplementary seal is arranged at the inner door of the at least one upper cooling compartment.

5. The ultra-low temperature freezer according to claim 1, wherein the supplementary seal is arranged on an inner side of the outer door facing the interior.

6. The ultra-low temperature freezer according to claim 1, wherein the supplementary seal has an extension in a horizontal direction which corresponds to a horizontal distance between the at least one upper cooling compartment, in particular its inner door, and an inner side of the outer door facing the interior or is larger than this horizontal distance.

7. The ultra-low temperature freezer according to claim 1, wherein the supplementary seal has at least one recess or gap.

8. The ultra-low temperature freezer according to claim 7, wherein the at least one recess or gap is arranged and constructed to receive a handle and/or a hinge of the inner door of the at least one upper cooling compartment.

9. The ultra-low temperature freezer according to claim 1, wherein the supplementary seal is arranged and constructed such that development of a vertical natural convection boundary layer between an upper and a lower part of the interspace in the interior between the cooling compartments and the inner side of the outer door is prevented or substantially interrupted.

10. The ultra-low temperature freezer according to claim 1, wherein a higher uniformity of temperature occurs among the several cooling compartments of the ultra-low temperature freezer than exists in a second ultra-low temperature freezer identical to the ultra-low temperature freezer excepting the supplementary seal.

* * * * *